US007346302B2

(12) United States Patent
Sato et al.

(10) Patent No.: US 7,346,302 B2
(45) Date of Patent: Mar. 18, 2008

(54) COLOR IMAGE FORMING APPARATUS AND ELECTRIC CHARGE ELIMINATING DEVICE

(75) Inventors: Yotaro Sato, Hachioji (JP); Takenobu Kimura, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 162 days.

(21) Appl. No.: 11/318,623

(22) Filed: Dec. 28, 2005

(65) Prior Publication Data

US 2006/0216074 A1 Sep. 28, 2006

(30) Foreign Application Priority Data

Mar. 23, 2005 (JP) ..... 2005-083304

(51) Int. Cl.
*G03G 15/16* (2006.01)

(52) U.S. Cl. ..... 399/296

(58) Field of Classification Search ..... 399/296
See application file for complete search history.

(56) References Cited

U.S. PATENT DOCUMENTS 5,923,938 A * 7/1999 Enomoto et al. ..... 399/303
7,209,692 B2 * 4/2007 Hamada et al. ..... 399/296
2004/0001730 A1 * 1/2004 Shin ..... 399/296

* cited by examiner

*Primary Examiner*—Quana Grainger
(74) *Attorney, Agent, or Firm*—Finnegan, Henderson, Farabow, Garrett & Dunner, L.L.P.

(57) ABSTRACT

A color image forming apparatus wherein the pre-secondary transfer electric charge eliminating device arranged intermediate between a primary transfer section and a secondary transfer section is provided with: a discharge electrode arranged on the side opposite to the toner carrier surface of an intermediate transfer member; and a counter electrode containing a discharge electrode and a conductive elastic member arranged at the opposed position beyond the intermediate transfer member so as to be pressed against the intermediate transfer member; wherein the pressing force of the aforementioned counter electrode against the rear surface of the intermediate transfer member is distributed in such a way that the pressure for the center of the intermediate transfer member is smaller than that for both ends thereof, in the transversal direction to the direction in which the intermediate transfer member rotates.

12 Claims, 4 Drawing Sheets

COLOR IMAGE FORMING APPARATUS AND ELECTRIC CHARGE ELIMINATING DEVICE

This application is based on Japanese Patent Application No. 2005-083304 filed on Mar. 23, 2005, in Japanese Patent Office, the entire content of which is hereby incorporated by reference.

BACKGROUND OF THE INVENTION

The present invention relates to a copying machine, printer, facsimile machine and image forming apparatus based on electrophotographic technology having the functions thereof, particularly to a color image forming apparatus having an intermediate transfer member, wherein a plurality of color toner images are superimposed on the intermediate transfer member.

In what is commonly known as an image forming apparatus based on electrophotographic technology using an intermediate transfer member, a toner image formed on an image carrier as an photoconductor is transferred onto the intermediate transfer member, and the toner image on the intermediate transfer member is transferred onto a transfer material (also called paper forms). In such a color image forming apparatus, the toner images sequentially formed on the image carrier and charged to have a predetermined polarity are superimposed and transferred onto an intermediate transfer member by static electricity. After that, the toner images on the intermediate transfer member are collectively transferred onto the transfer material.

The image forming apparatus using the aforementioned intermediate transfer member ensures that the toner image formed on the image carrier is superimposed on the intermediate transfer member, and therefore, is extensively employed in the color image forming apparatus for forming a color image on the transfer material. In this color image forming apparatus, the toner images of various colors formed on the image carrier are superimposed on the intermediate transfer member and are transferred thereon. Then the superimposed toner images are collectively transferred onto the transfer material by static electricity.

Since the amount of electric charge per toner particle is almost uniform, the electric potential of the toner layer on the intermediate transfer member is determined by the amount of toner deposited in a predetermined area. In the color image forming apparatus, the electric potential of electric charge in the portion where a plurality of the toners in different colors are superimposed in the toner images on the intermediate transfer member is greater than that in the portion where only the toner of one color is deposited. For example, when the toner image on the aforementioned intermediate transfer member has a solid portion and half-tone portion, the electric potential of the solid portion is greater than that of the half-tone portion.

After having passed through the primary transfer section wherein a toner image is transferred from the image carrier to the intermediate transfer member, the variation in the potential of the electric charge in the toner image may be produced depending on the environment.

As described above, if there is a big variation in the electric potential of the electric charge of the toner image on the intermediate transfer member, the portions with different transfer characteristics are present in one and the same toner image. If the portions with different transfer characteristics are to be transferred onto the transfer material under the same transfer conditions, various types of image failures tend to occur at the time of the secondary transfer from the intermediate transfer member to the transfer material.

In recent years, color printing technology has made a remarkable development in a copying machine, printer, facsimile machine and image forming apparatus having the functions thereof. As a result of adopting polymerized toner and small particle-sized toner, there has been a growing demand for higher image quality in the transfer process. Further, the speed in the image forming apparatus is getting higher and higher. To obtain a high quality image under this context, correction must be made to ensure that the electric potential of toner on the intermediate transfer member that varies with the frequency of primary transfer and environment is approximately uniform, thereby the secondary transfer performance is improved.

To solve aforementioned problems, Patent Document 1 proposes a structure having a pre-transfer charging device to charge the toner image after having been primarily transferred onto the intermediate transfer member before being secondarily transferred onto the transfer material, and which pre-transfer charging device disposes a conductive roller member arranged on the back of the intermediate transfer member opposed to the electrode of this charger and the charger whereby a counter electrode is formed. According to this method, a toner image primarily transferred onto the intermediate transfer member is charged by AC/DC corona discharging so that the amount of electric charge is approximately uniform.

The Patent Document 2 proposes a method of arranging a control section for controlling the charging conditions by the pre-secondary transfer charging device, in response to the traveling speed of the intermediate transfer member surface passing through the charging position where the pre-secondary transfer charging device charges.

[Patent Document 1] Official Gazette of Japanese Patent Tokkaihei 10-274892

[Patent Document 2] Official Gazette of Japanese Patent Tokkaihei 11-143255

According to the methods described in Patent Documents 1 and 2, the amount of electric charge of toner on the intermediate transfer member is uniformly set to a greater value. If the paper has a high resistance under low-humidity condition or during transfer onto the second face in the duplex copying mode, an image failure tends to be caused by the electric discharge due to the high electric potential of the paper. If the transfer voltage is reduced in order to avoid such an image failure, an insufficient transfer electric field occurs to the greater portion of the overall electric charge on the toner layer, and this will produce uneven density.

In the pre-transfer charging device described in Patent Documents 1 and 2 wherein a conductive roller member is arranged on the back of the intermediate transfer member opposed to the charger and a counter electrode is formed thereby, sufficient charging effects cannot be obtained easily if the speed of the image forming apparatus and the linear speed of the intermediate transfer member are increased. Further, the structure will become more complicated, for example, in order to control the charging condition in response to the linear speed of the intermediate transfer member.

In the meantime, if a flat counter electrode is pressed against the surface of the belt-shaped intermediate transfer member, the pressure at the central portion is inevitably reduced, with the result that the compression amount of the conductive elastic member is reduced. This will deteriorate the flatness of the belt-shaped intermediate transfer member.

The distance between the grid of the scorotron electrode and the intermediate transfer member will be different according to the position. This will produce variations in the electric charge elimination performance of toner.

SUMMARY OF THE INVENTION

An object of the present invention is to solve the aforementioned problems and to obtain high-quality image with improving transfer efficiency of secondary transfer even if the liner speed of intermediate transfer member is increase due to increase of image forming speed. Another object of the present invention is to provide an image forming apparatus having an pre-secondary transfer electric charging eliminating device capable of long term durable transfer.

The aforementioned object of the present invention can be achieved by the following structure:

The structure of the color image forming apparatus of the present invention, including: a primary transfer section to transfer and superimpose toner images of multiple colors formed on a plurality of image carriers onto a rotating intermediate transfer member; a secondary transfer section to transfer the toner images superimposed on the intermediate transfer-member collectively on a transfer material; a pre-secondary transfer electric charge eliminating device arranged between the primary transfer section and secondary transfer section including, a discharge electrode arranged on the side opposite to the toner carrier surface of the intermediate transfer member and a counter electrode formed by a conductive elastic member arranged at a position opposite to the discharge electrode having the intermediate transfer member in between so as to press the intermediate transfer member, wherein the pressing force of the counter electrode against the rear surface of the intermediate transfer member is distributed in such a way that the pressure for the center of the intermediate transfer member is smaller than that for both ends thereof, in the transversal direction to the direction in which the intermediate transfer member rotates.

BRIEF DESCRIPTION OF THE DRAWINGS

FIG. 3 (*b*) is cross sectional view of the pre-secondary transfer electric charge eliminating device as viewed in the sub-scanning direction;

FIG. 5 (*b*) is a cross sectional-view of the pre-secondary transfer electric charge eliminating device;

FIG. 6 (*b*) is a cross sectional view of the pre-secondary transfer electric charge eliminating device.

DESCRIPTION OF THE PREFERRED EMBODIMENT

The following describes the present invention with reference to embodiments, without the present invention being restricted thereto:

[Color Image Forming Apparatus]

Figure 1:
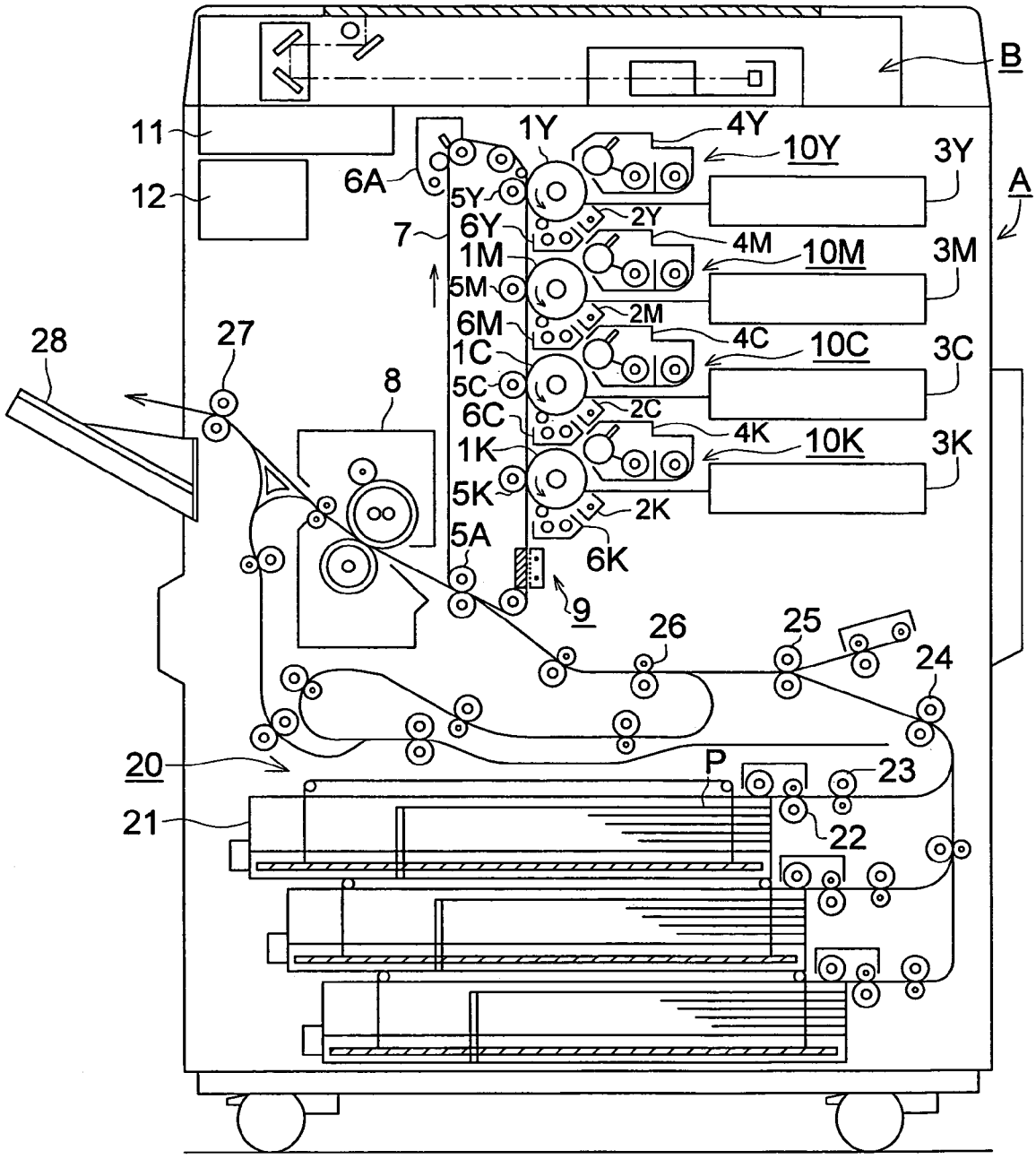
FIG. 1 is a cross sectional view of the overall structure of a color image forming apparatus A as an embodiment of the present invention.
Figure 2:
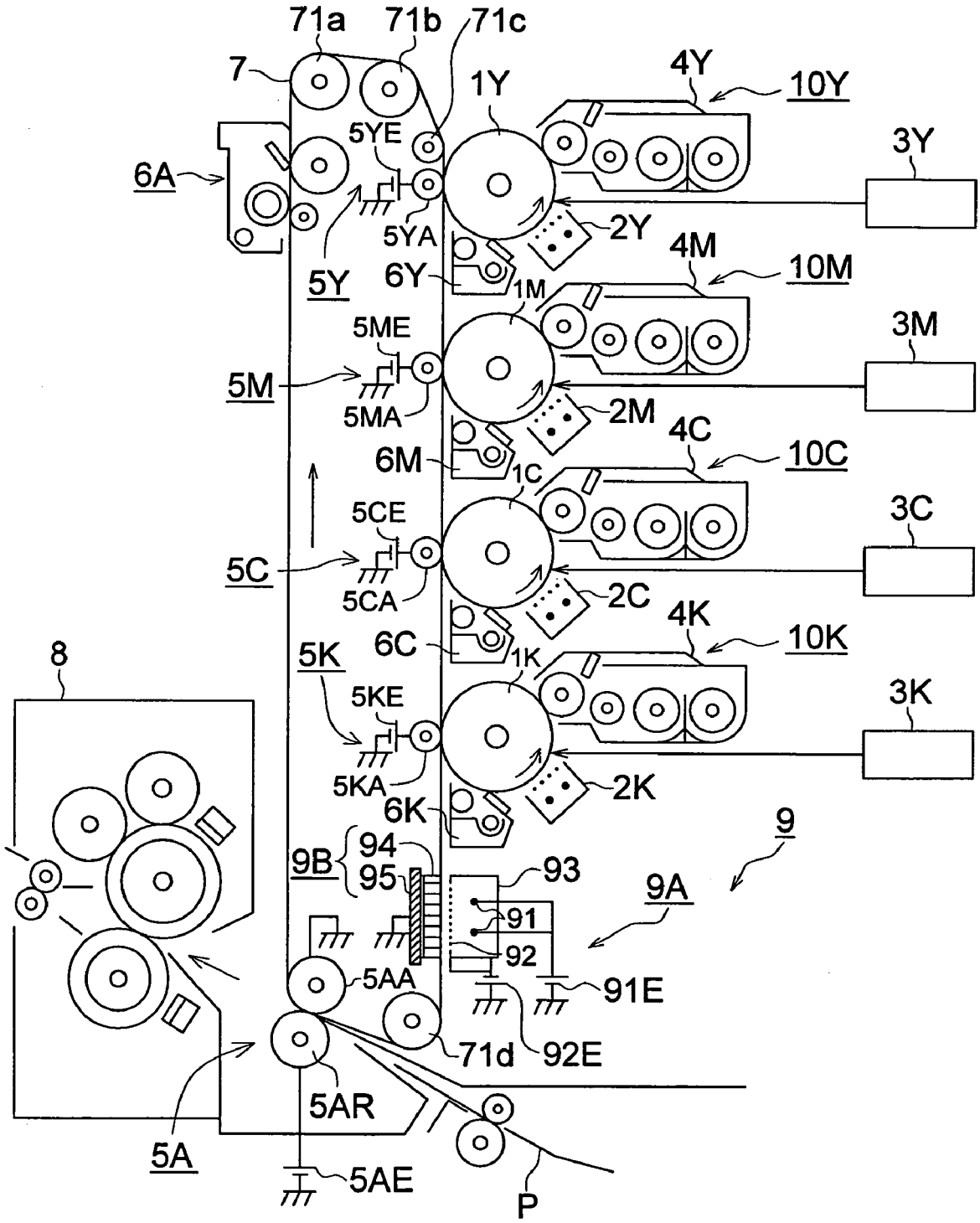
FIG. 2 is a cross-sectional view of the major portions of the color image forming apparatus A.

FIG. 1 is a cross sectional view of the overall structure of a color image forming apparatus A as an embodiment of the present invention. FIG. 2 is a cross sectional view of the major portions of the color image forming apparatus A.

The color image forming apparatus A is called a tandem type color image forming apparatus, and is provided with:

a plurality of image forming sections 10Y, 10M, 10C and 10K;

a belt-shaped intermediate transfer member 7;

an intermediate transfer unit including primary transfer sections 5Y, 5M, 5C and 5K and a secondary transfer section 5A;

a sheet feeding apparatus 20;

a fixing apparatus 8;

an operation section 11, and an imaging control section 12.

An image reading apparatus B is mounted on the color image forming apparatus A. A document placed on the document platen has its image scanned and exposed by the optical system of a document image scanning/exposure apparatus of the image reading apparatus B, and the image is captured by the line image sensor. The analog signal subjected to photoelectric conversion by the line image sensor is subjected to analog processing, analog-to-digital conversion, shading correction, image compression and other processing by the image processing section. After that, the signal is inputted into the exposure sections 3Y, 3M, 3C and 3K.

The image forming section 10Y for forming a yellow (Y) image is provided with a charging device 2Y, exposure section 3Y, developing section 4Y and cleaning section 6Y arranged around an image carrier 1Y.

The image forming section 10M for forming a magenta (M) image is provided with an image carrier 1M, charger 2M, exposure section 3M, developing section 4M and cleaning section 6M.

The image forming section 11C for forming a cyan (C) image is provided with an image carrier 1C, charger 2C, exposure section 3C, developing section 4C and cleaning section 6C.

The image forming section 10K for forming a black (K) image is provided with an image carrier 1K, charger 2K, exposure section 3K, developing section 4K and cleaning section 6K.

The charging device 2Y and exposure section 3Y, charger 2M and exposure section 3M, charger 2C and exposure section 3C, and charger 2K and exposure section 3K constitute a latent image forming section.

An OPC photoconductor, aSi photoconductor or similar device known in the prior art is used as the image carrier 1Y, 1M, 1C or 1K. The OPC photoconductor is preferably used and especially, the OPC photoconductor of negative charge is preferably used in the present embodiment.

A corona discharge device such as scorotron or corotron is used as the charging device 2Y, 2M, 2C or 2K. The scorotron discharge device is preferably used.

A light emitting device for emitting light according to image data such as a laser or LED array is used as the exposure section 3Y, 3M, 3C or 3K.

The belt-shaped intermediate transfer member 7 is a semiconducting device. It is wound by a plurality of rollers 71*a*, 71*b*, 71*c* and 71*d*, and is supported so as to be moved in circulation. In the present embodiment, the intermediate transfer member 7 are supported in a flat form between the rollers 71*c* and 71*d*. To put it another way, the rollers 71*c* and 71*d* serve as support members.

The images of various colors formed by the image forming sections 10Y, 10M, 10C and 10K are transferred onto the rotating intermediate transfer member 7 sequentially by the primary transfer sections 5Y, 5M, 5C and 5K (primary transfer).

The transfer material P accommodated in the sheet storage section (sheet storage cassette) 21 of the sheet feeding apparatus 20 is fed by the sheet feed section (first sheet feed section) 22, and is conveyed to the secondary transfer sections 5A via the sheet feed rollers 23, 24 and 25, and resist roller (second sheet feed section) 26 (secondary transfer).

Heat and pressure are applied to the transfer material P with color image transferred thereon, by the fixing apparatus 8. The color toner image (or toner image) on the transfer material P is fixed, and is secured on the transfer material P. Then the transfer material P is ejected from an ejection roller 27.

After the color image has been transferred onto the transfer material P by the secondary transfer sections 5A, the intermediate transfer member 7 separates the transfer material P with curvature-separation and the remaining toner is removed by the cleaning section 6A from the intermediate transfer member 7.

[Primary Transfer Section]

The primary transfer section 5Y for transferring the yellow image is made up of a primary transfer roller 5YA and a primary transfer power source 5YE for applying voltage to the primary transfer roller 5YA. The primary transfer roller 5YA is opposed to the image carrier 1Y via the intermediate transfer member 7, and is pressed against the inner surface of the intermediate transfer member 7. The primary transfer power source 5YE is grounded.

The primary transfer section 5M for transferring the magenta image is made up of a primary transfer roller 5MA and a primary transfer power source 5ME for applying voltage to the primary transfer roller 5MA. The primary transfer roller 5MA is opposed to the image carrier 1M via the intermediate transfer member 7, and is slidably in contact with the inner surface of the intermediate transfer member 7. The primary transfer power source 5ME is grounded.

The primary transfer section 5C for transferring the cyan image is made up of a primary transfer roller 5CA and a primary transfer power source 5CE for applying voltage to the primary transfer roller 5CA. The primary transfer roller 5CA is opposed to the image carrier 1C via the intermediate transfer member 7, and is slidably in contact with the inner surface of the intermediate transfer member 7. The primary transfer power source 5CE is grounded.

The primary transfer section 5K for transferring the black image is made up of a primary transfer roller 5KA and a primary transfer power source 5KE for applying voltage to the primary transfer roller 5KA. The primary transfer roller 5KA is opposed to the image carrier 1K via the intermediate transfer member 7, and is sidably in contact with the inner surface of the intermediate transfer member 7. The primary transfer power source 5KE is grounded.

A current value of 40 μA and a voltage of +1.5 kV are applied to the primary transfer power sources 5YE, 5ME, 5CE and SKE.

Except at the time of primary transfer, the primary transfer section sources 5Y, 5M, 5C and 5K are separated by a separation apparatus (not illustrated) and is removed from the inner surface of the intermediate transfer member 7 and retracted.

[Secondary Transfer Section]

As shown in FIG. 2, the secondary transfer sections 5A is made up of a secondary transfer backup roller 5AA, a secondary transfer roller 5AR and a primary transfer power source 5AE. The secondary transfer backup roller 5AA is opposed to the secondary transfer roller 5AR through intermediate substance and is slidably in contact with the inner surface of the intermediate transfer member 7. The secondary transfer backup roller 5AA is grounded. The primary transfer power source 5AE for applying voltage to the secondary transfer roller 5AR is grounded.

The reference numeral 6A denotes an intermediate transfer member cleaning device for cleaning the intermediate transfer member 7, and 8 indicates a fixing apparatus for fixing a toner image onto the transfer material P.

The intermediate transfer member 7 is a single layered or multi-layered belt made of polyamide or polyimide, and has a volume resistivity of $10^7$-$10^{12}$ Ωcm.

After the image has been secondarily transferred from the intermediate transfer member 7 onto the transfer material P by the secondary transfer sections 5A, the intermediate transfer member 7 passes through the intermediate transfer member cleaning device 6A to be cleaned.

A current value of 50 μA and a voltage of +3 kV are applied to the primary transfer power source 5AE of the secondary transfer sections 5A. The secondary transfer backup roller 5AA of the secondary transfer sections 5A has almost the same structure as the primary transfer rollers 5YA, 5MA, 5CA and 5KA, and is slidably in contact with the inner surface of the intermediate transfer member 7.

Except at the time of secondary transfer, the secondary transfer roller 5AR is moved by a separation apparatus (not illustrated) and is removed from the surface of the intermediate transfer member 7 and retracted.

[Pre-Secondary Transfer Electric Charge Eliminating Device]

As shown in FIG. 2, a pre-secondary transfer electric charge eliminating device 9 is arranged where the intermediate transfer member 7 is supported in a flat form between the primary transfer section 5K and the secondary transfer sections 5A along the intermediate transfer member 7.

The color image forming apparatus based on intermediate transfer method involves such a problem that a high-quality image cannot be obtained due to deteriorated secondary transfer performance in the secondary color, even if the primary transfer performance is excellent in the primary color. This is because the toner image formed on the intermediate transfer member 7 has depositions over a wide range from one layer up to four layers, and the optimization of the secondary transfer conditions is deteriorated in accordance with each volume of deposition.

To solve this problem, a pre-secondary transfer electric charge eliminating device 9 is provided to eliminate electric charges from the toner image on the intermediate transfer member 7, thereby ensuring a uniform amount of electric charge. This arrangement protects excellent secondary transfer performance against depositions of toner over a wide range.

However, to ensure electric charge elimination efficiency in the face of an ever increasing process speed of the image forming apparatus, the length of the electric charge elimination electrode 9A of the pre-secondary transfer electric charge eliminating device 9 must be increased in the sub-scanning direction (in the forward direction of the intermediate transfer member 7). This inevitably requires the length of the counter electrode 9B to be increased.

Rollers have been used in many of the counter electrodes 9B. To cope with the increasing process speed of the image forming apparatus, the length in contact with the intermediate transfer member 7 should be increased. At the same time, it is necessary to determine the optimum distance between the intermediate transfer member 7 and pre-secondary transfer electric charge eliminating device 9.

To meet these two requirements, it is necessary to increase the outer diameter of the roller 71*d* and the winding angle of the belt-shaped intermediate transfer member 7. This involves the problems of the increased size of the apparatus and increased production costs.

To solve these problems, it is necessary to ground the conductive brush and the counter electrode 9B such as a conductive foamed (porous) member in surface contact with the intermediate transfer member 7. This improves electric charge elimination efficiency.

(Electric Charge Elimination Electrode 9A)

Figure 3:
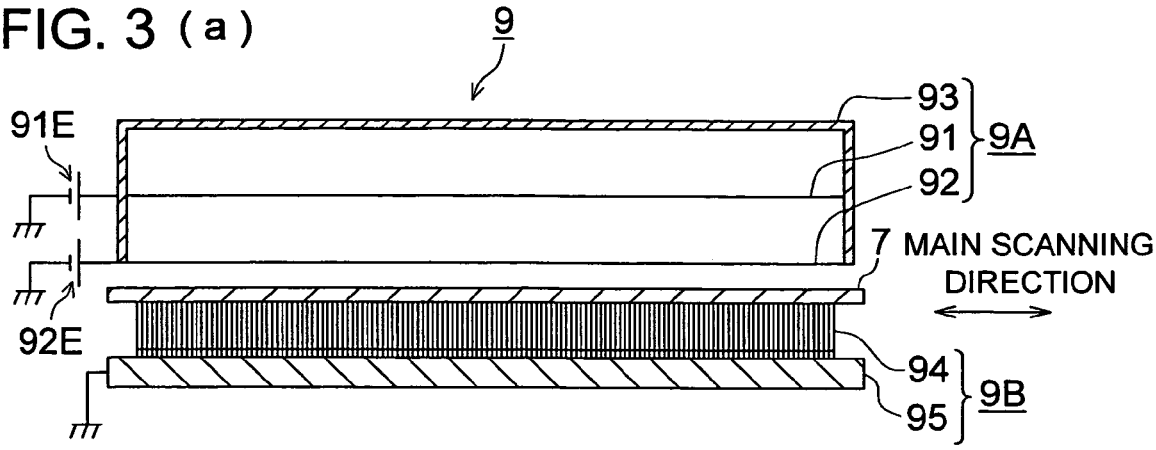
FIG. 3 (*a*) is cross sectional view of the pre-secondary transfer electric charge eliminating device as viewed in the main scanning direction.
Figure 3:
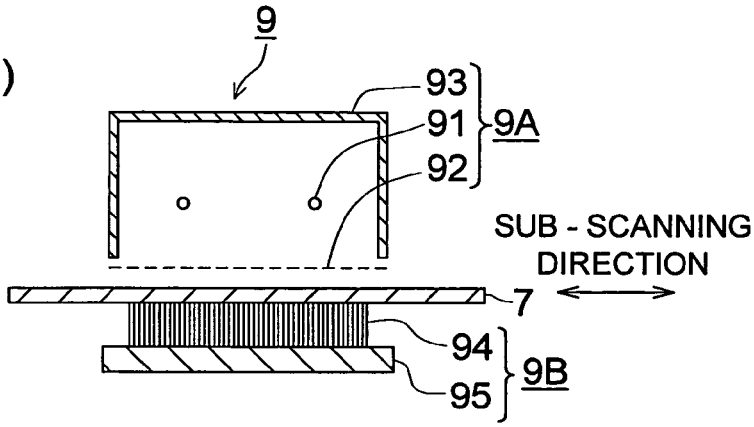

FIG. 3 is a cross sectional view of the pre-secondary transfer electric charge eliminating device 9. FIG. 3 (*a*) is a cross sectional view of the pre-secondary transfer electric charge eliminating device 9 as viewed in the main scanning direction. FIG. 3 (*b*) is a cross sectional view as seen in the sub-scanning direction.

The pre-secondary transfer electric charge eliminating device 9 is made up of electric charge elimination electrode 9A arranged on the image carrier side of the intermediate transfer member 7, and a counter electrode 9B mounted on the inner surface of the intermediate transfer member 7.

The electric charge elimination electrode 9A is a scorotron electric charge elimination electrode provided with a discharge electrode 91, a grid electrode 92 and a casing 93. The potential of the grid electrode 92 of the electric charge elimination electrode 9A does not exceed the electric potential of the toner image in the maximum deposition area, and is not less than the potential in the portion where toner is not deposited. The d.c. voltage having a polarity opposed to that of toner is applied to the discharge electrode 91 (charged wire) of the scorotron charger.

The discharge electrode 91 is connected to a power source 91E. The grid electrode 92 is arranged opposed to the belt surface of the intermediate transfer member 7, with a predetermined spacing between them, and is connected to the power source 92E. The casing 93 is connected to the same electric potential as that of the grid electrode 92 through a circuit (not illustrated).

A wire rod made of tungsten stainless steel or gold having a diameter of 20 through 150 μm can be used as the discharge electrode 91. The surface in particular is preferably made of gold. The wire rod itself can be made of gold. Alternatively, the surface of stainless steel or tungsten substrate can be coated with gold. The average thickness of the gold coated film is preferably 1 through 5 μm from the viewpoint of the efficiency of removing such a discharged product as ozone, production cost and discharge efficiency.

A plate-shaped grid with a pattern formed on a wire grid or sheet metal by etching or a gold plated plate-shaped grid is adopted as the grid electrode 92.

The d.c. voltage with a d.c. bias voltage of 0 to +5 kV to be discharged, having a polarity opposed to that of toner, can be applied to the discharge electrode 91, and the voltage of 0 to −300 V can be applied to the grid electrode 92.

In the present embodiment, the d.c. voltage with a d.c. bias voltage of 0 through +5 kV to be discharged, having a polarity opposed to that of toner, can be applied to the discharge electrode 91, and the voltage of 0 through −300 V can be applied to the grid electrode 92.

In the present embodiment, +4 kV voltage is applied to the discharge electrode 91 of the pre-secondary transfer electric charge eliminating device 9, and −50 V voltage is applied to the grid electrode 92.

<Counter Electrode 9B>

A conductive brush (conductive elastic member) 94 and a support member 95 for supporting the conductive brush 94 are mounted on the inner surface of the intermediate transfer member 7 opposed to the pre-secondary transfer electric charge eliminating device 9. The conductive brush 94 is slidably in contact with the inner surface of the intermediate transfer member 7 and is grounded.

The conductive brush 94 is preferably made of a conductive resin material such as acryl, nylon and polyester, and the wire size is 0.111 through 0.778 tex in terms of the measuring unit according to the count system proposed in ISO. The brush density is preferably 12,000 through 77,000 lines/cm$^2$, and the resistance of the raw fabric is preferably $10^{\circ}$ through $10^5$ Ωcm.

The support member 95 is made up of a conductive member and is grounded.

Figure 4:
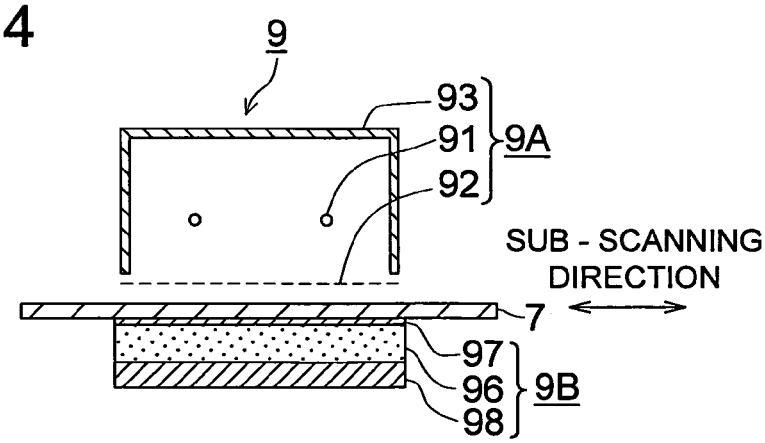
FIG. 4 is a cross sectional view of the pre-secondary transfer electric charge eliminating device as viewed in the sub-scanning direction as another embodiment of the present invention.

FIG. 4 is a cross sectional view of the pre-secondary transfer electric charge eliminating device 9 as viewed in the sub-scanning direction as another embodiment of the present invention.

The counter electrode 9B of the pre-secondary transfer electric charge eliminating device 9 can be a conductive foamed member grounded.

The counter electrode 9B is made up of a conductive foamed member 96, a wear resistant conductive member 97 slidably in contact with the inner surface of the intermediate transfer member 7, and a support member 98 for supporting the conductive foamed member 96 which are sandwiched integrally in a layer stack form.

A urethane rubber such as an ether based polyurethane rubber, an ethylene/propylene rubber, hydrin rubber and a silicone rubber can be used as the conductive foamed member 96. The volume resistivity does not exceed $10^{11}$ Ω·cm; it is preferably in the range from $10^3$ through $10^9$ Ω·cm.

The conductive foamed member 96 is exemplified by a conductive carbon black mixed with the foamed member such as sponge. The conductive foamed member 96 can be produced as follows: A solution with carbon black dispersed therein is impregnated with a high molecular material, whereby the conductive foamed member 96 is produced. Alternatively, in the phase of mixing, the carbon black is kneaded into resin, whereby the conductive forming member 96 is produced. The forming material mixed with carbon black allows electricity to flow through the high molecular material.

Except for the method of using the carbon black, there is a method of encouraging ionization due to delocalization of electric charge, by mixing (doping) iodine or arsenic pentafluoride into a compound with the principal chain formed by conjugate double bondage as exampled by polyacetylene, polyphenylacetylene, poly-p-phenylene, metallic phthalocyanine polymer.

The wear-resistant material such as a conductive stainless steel plate, copper alloy, zinc alloy, or tin alloy is used as the conductive member 97.

Similarly to the support member 95, the support member 98 is made up of a conductive member and is grounded.

<Conductive Elastic Member>

In the following description, the conductive brush 94 of the counter electrode 9B and conductive forming member 96 will be referred to as "conductive elastic member 99". The conductive elastic member 99 is slidably in contact with the inner surface of the endless intermediate transfer member 7. The outer surface side of the intermediate transfer member 7 and the grid electrode 92 of the electric charge elimination electrode 9A must be kept uniformly at a predetermined spacing.

Figure 5:
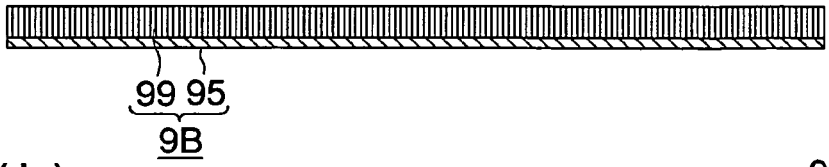
FIG. 5 (*a*) is a cross sectional view of the conventional counter.
Figure 5:
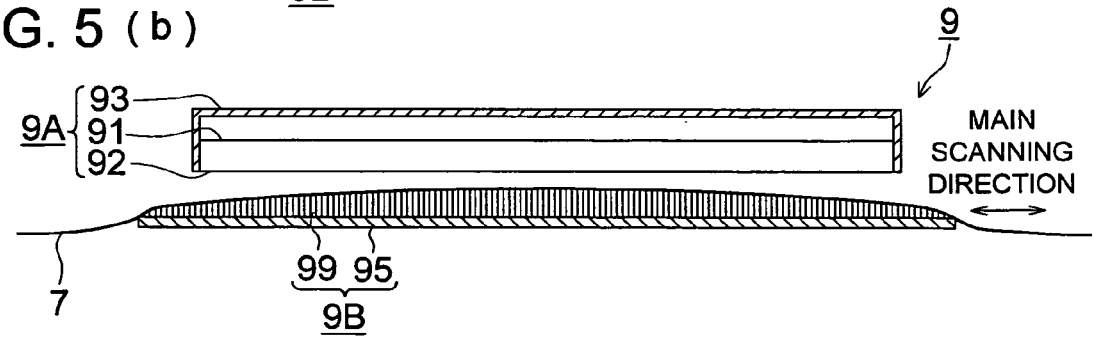

FIG. 5 is a cross sectional view of the conventional counter electrode 9B and pre-secondary transfer electric charge eliminating device 9.

FIG. 5 (*a*) is cross sectional view showing the conventional counter electrode 9B alone. The conductive elastic member 99 of the counter electrode 9B is formed of a uniform material along the overall length, and is held by the support member 95 to a uniform thickness.

FIG. 5 (*b*) is a cross sectional view of the pre-secondary transfer electric charge eliminating device 9 when the conventional counter electrode 9B is mounted on the inner surface of the intermediate transfer member 7 inside the color image forming apparatus A.

When formed of a uniform material along the overall length in the main scanning direction as the conductive elastic member of the counter electrode 9B, the intermediate transfer member 7 is stretched by the tension between the primary transfer sections 5Y, 5M, 5C and 5K and secondary transfer sections 5A. Compressive force is applied close to both ends of the conductive elastic member 99 of the pre-secondary transfer electric charge eliminating device 9, with the result that the portion close to the center of the conductive elastic member 99 is risen and expanded.

Thus, the distance G between the intermediate transfer member 7 and grid electrode 92 is reduced close to the center of the conductive elastic member 99. This will cause excessive elimination of electric charge and toner will be dispersed on the thin wired portion.

The distance G between the intermediate transfer member 7 and grid electrode 92 is increased close to the center of the conductive elastic member 99. This will cause insufficient elimination of electric charge and will deteriorate the two-color solid uniformity of superimposed color toner images.

Figure 6:
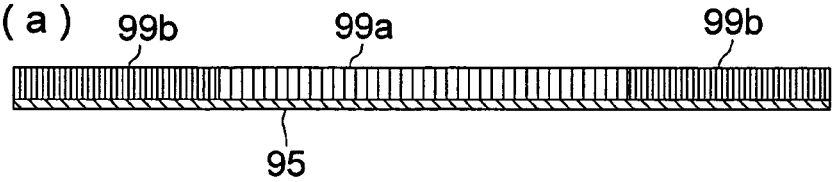
FIG. 6 (*a*) is a cross sectional view of the counter electrode.
Figure 6:
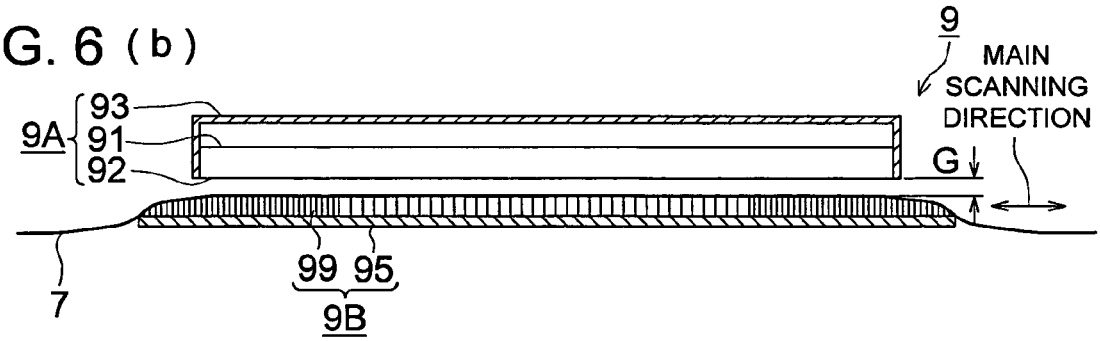

FIG. 6 is a cross sectional view of the counter electrode 9B and pre-secondary transfer electric charge eliminating device 9 of the present invention.

Figure 7:
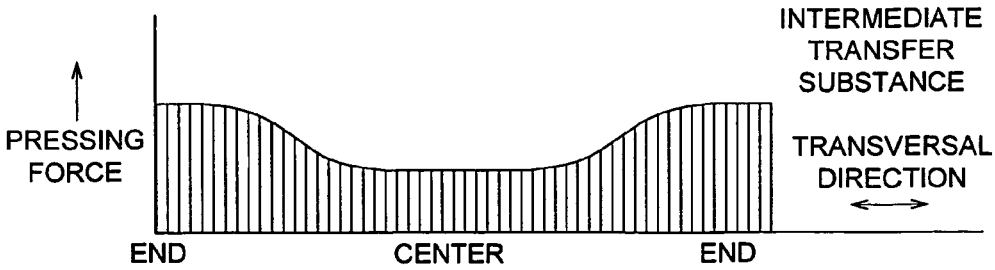
FIG. 7 is a diagram representing the distribution of pressing force applied onto the rear surface of the intermediate transfer member by the counter electrode in the transversal direction to the rotary direction.

FIG. 6 (*a*) is a cross sectional view of the counter electrode 9B of the present invention alone. Thus, the conductive elastic member 99 of the counter electrode 9B exhibits such a distribution of the pressing force shown in FIG. 7 that the pressure of the counter electrode 9B against the rear surface of the intermediate transfer member 7 is smaller on the central portion rather than on the both ends of the intermediate transfer member 7 in the transverse direction (in the main scanning direction) to the direction in which the intermediate transfer member 7 rotates.

To be more specific, the central portion 99*a* of the conductive elastic member 99 (e.g. length in the main scanning direction: about 160 mm) is formed on a highly elastic member, and both ends 99*b* of the conductive elastic member 99 (e.g. each length in the main scanning direction: about 80 mm) are formed on less elastic member.

For example, when the conductive brush 94 is used as the conductive elastic member 99, the conductive brush 94 is formed in such a way that the length of the bristles on the conductive brush 94 opposed to the position close to the center of the intermediate transfer member 7 is smaller than that of the bristles opposed to the position close to both ends.

Further, the conductive brush 94 is formed in such a way that the coefficient of elasticity (Young's modulus) opposed to the position close to the center of the intermediate transfer member 7 is smaller than that opposed to the position close to both ends. Alternatively, the conductive brush 94 is formed in such a way that the wire size opposed to the position close to the center of the intermediate transfer member 7 is smaller than that opposed to the position close to both ends.

Further, the conductive brush 94 is formed in such a way that the wire diameter opposed to the position close to the center of the intermediate transfer member 7 is smaller than that opposed to the position close to both ends.

Further, the conductive brush 94 is formed in such a way that the density opposed to the position close to the center of the intermediate transfer member 7 is smaller than that opposed to the position close to both ends.

For example, when the conductive foamed member 96 is used as the conductive elastic member 99, the conductive foamed member 96 is formed in such a way that the thickness opposed to the position close to the center of the intermediate transfer member 7 is smaller than that opposed to the position close to both ends.

Further, the conductive foamed member 96 is formed in such a way that the hardness opposed to the position close to the center of the intermediate transfer member 7 is smaller than that opposed to the position close to both ends.

The elasticity of the conductive elastic member 99 is provided on three positions; central portion 99*a* and both ends 99*b*, without the present invention being restricted thereto. The central portion 99*a* and both ends 99*b* can be further subdivided into more than four areas.

FIG. 6 (*b*) is a cross sectional view of the pre-secondary transfer electric charge eliminating device 9 wherein the counter electrode 9B is arranged in contact with the intermediate transfer member 7.

The conductive elastic member 99 compressed by the intermediate transfer member 7 is subjected to uniform compression along the overall length, when the conductive elastic member 99 of the counter electrode 9B is made of the material characterized by such a distribution of pressing force that the pressure is smaller at the center of the intermediate transfer member 7 or thereabouts than that for both ends of the intermediate transfer member 7, namely, when the conductive elastic member 99 of the counter electrode 9B is made of the elastic member characterized by such a pressing force distribution that the pressure at the center or thereabouts is smaller than that for both ends if the conductive elastic member 99 is pressed by a flat plate.

This arrangement provides a uniform distance G between the intermediate transfer member 7 and grid electrode 92, and a constant electric charge elimination performance along the overall length, thereby ensuring a uniform two-color solid image close to both ends and the center, and an excellent image formation of the thin-line portion.

EMBODIMENT

[Image Formation Condition]

Image forming apparatus: Outputs 51 full-colored A4 documents per minute; A modified version of tandem full-color copying machine (Konica Minolta 8050 (registered trademark); FIG. 1)

[Pre-Secondary Transfer Electric Charge Eliminating Device]

Intermediate transfer member 7: polyimide endless belt; volume resistivity: $10^9$ Ω·cm; surface resistance: $10^{11}$Ω

Linear speed of intermediate transfer member 7: 200 through 500 mm/sec.

Electric charge elimination electrode 9A: scorotron charger

Grid electrode 92 of electric charge elimination electrode 9A and casing 93: −50 V, same electric potential Counter electrode 9B: grounded to the GND Conductive brush 94 of the counter electrode 9B: conductive nylon; wire size: 3d (deniers); density: 200 kF/square inch (where F denotes the number of filaments, and one inch is equivalent to 25.4 mm); bristle length: 3 mm; resistance of raw fabric: $10^2$Ω; in slight contact with the intermediate transfer member 7

Conductive foamed member 96 of counter electrode 9B: carbon black mixed with an foamed member such as sponge

[Measuring Conditions]

An image pattern with solid image and thin-lined image formed in the entire area of the ends and center of the intermediate transfer member 7 was outputted in the low-temperature environment (10° C. with 20% RH). Images were formed using various types of the counter electrode 9B, and were evaluated. For electric charge elimination, a voltage of +5 kV was applied to the discharge electrode 91 and the grid electrode 92 was set at −50 V. Further, the counter electrode 9B was installed in contact with the intermediate transfer member 7, and the distance G between the intermediate transfer member 7 and grid electrode 92 was measured on both ends and center of the intermediate transfer member 7 under this condition.

[Results of Measurement]

Table 1 (a) shows the result of measuring the distance G between the intermediate transfer member 7 and grid electrode 92, uniformity of two-color solid images, and dispersion of toner over the thin-lined portion, in embodiments 1 through 6 and comparative examples 1 and 2.

Table 1 (b) shows the brush characteristics showing the length of the bristles of the conductive brush 94, Young's modulus, diameter of wire, and density, in embodiments 1 through 4 and comparative example 1.

Table 1 (c) shows the sponge characteristics exhibiting the material quality, thickness and Asker F hardness of the conductive foamed member 96, in embodiments 4 and 5 and comparative example 2.

TABLE 1

(a)

| | Counter electrode (9B) | | | Distance between belgt and grid (G) | | Two-color solid uniformity | | Toner dispersion over thin wired portion | | |
|---|---|---|---|---|---|---|---|---|---|---|
| | Type | Ends | Center | Ends | Center | Ends | Center | Ends | Center | Evaluation |
| Comparative example 1 | Brush | Uniform over the entire material area | | 1.3 mm | 0.7 mm | D | B | B | D | D |
| Embodiment 1 | Brush | Bristle length: 4 mm | Bristle length: 3 mm | 1.1 mm | 1.0 mm | B | B | B | B | B |
| Embodiment 2 | Brush | *1 | *2 | 1.1 mm | 0.9 mm | B | B | B | B | B |
| Embodiment 3 | Brush | Wire size 6 d | Wire size 2 d | 1.0 mm | 0.9 mm | B | B | B | B | B |
| Embodiment 4 | Brush | Density 240 kF | Density 120 kF | 1.1 mm | 1.0 mm | B | B | B | B | B |
| Comparative example 2 | Sponge | Uniform over the entire material area | | 1.3 mm | 0.6 mm | D | B | B | D | D |
| Embodiment 5 | Sponge | Thickness 5 mm | Thickness 4 mm | 1.1 mm | 0.9 mm | B | B | B | B | B |
| Embodiment 6 | Sponge | Hardness 90 | Hardness 80 | 1.1 mm | 0.9 mm | B | B | B | B | B |

(b) Brush characteristics

| | Material | Bristle length | Young's modulus ($N/m^2$) | Wire size | Density |
|---|---|---|---|---|---|
| Comparative example 1 | Conductive nylon | 4 mm | 1500 | 6 d | 240 kF |
| Embodiment 1 | Conductive nylon | Value in Table 1 | 1500 | 6 d | 240 kF |
| Embodiment 2 | Conductive nylon | 4 mm | Value in Table 1 | 6 d | 240 kF |
| Embodiment 3 | Conductive | 4 mm | 1500 | Value | 240 kF |

TABLE 1-continued

| | | | | | |
|---|---|---|---|---|---|
| | nylon | | | in Table 1 | |
| Embodiment 4 | Conductive nylon | 4 mm | 1500 | 6 d | Value in Table 1 |

(c) Sponge characteristics

| | Material | Thickness | Asker F hardness |
|---|---|---|---|
| Comparative example 2 | Value in Table 1 | 5 mm | 90° |
| Embodiment 4 | Value in Table 1 | Value in Table 1 | 90° |
| Embodiment 5 | Value in Table 1 | 5 mm | Value in Table 1 |

*1 Young's modulus 1500 N/m$^2$
*2 Young's modulus 1000 N/m$^2$

As shown in Table 1 (a), in the comparative examples 1 and 2 wherein the material of the conductive elastic member 99 such as the conductive brush 94 and conductive foamed member 96 is uniform along the entire length (FIG. 5 (*a*)), both ends of the conductive elastic member 99 are compressed by the tension of the intermediate transfer member 7, as shown in FIG. 5 (*b*). The position close to the center of the conductive elastic member 99 is risen and expanded.

Thus, in comparative example 1, the distance G between the intermediate transfer member 7 and grid electrode 92 is smaller than the ideal value of 0.9 through 1.1 mm at the center of the conductive brush 94 (distance at the center: 0.7 mm). This will result in excessive elimination of electric charge, and toner dispersion occurs in the thin line area. At both ends of the conductive brush 94, the distance G between the intermediate transfer member 7 and grid electrode 92 is greater than the ideal value of 0.9 through 1.1 mm (distance at both ends: 1.3 mm). This will result in insufficient elimination of electric charge, and will deteriorate the two-color solid uniformity of color toner images.

In the conductive foamed member 96 of the comparative example 2 (FIG. 4), the distance G is smaller than the ideal value of 0.9 through 1.1 mm (distance at the center: 0.6 mm). This will result in excessive elimination of electric charge, and toner dispersion occurs in the thin line area. At both ends of the conductive brush 94, the distance G between the intermediate transfer member 7 and grid electrode 92 is greater than the ideal value of 0.9 through 1.1 mm (distance at both ends: 1.3 mm). This will result in insufficient elimination of electric charge, and will deteriorate the two-color solid uniformity of color toner images.

By contrast, the conductive elastic member 99 compressed by the intermediate transfer member 7 is subjected to uniform compression along the overall length, when the conductive elastic member 99 of the counter electrode 9B is made of the material characterized by such a distribution of pressing force that the pressure is smaller at the center of the intermediate transfer member 7 or thereabouts than that for both ends of the intermediate transfer member 7, namely, when the conductive elastic member 99 of the counter electrode 9B is made of the elastic member characterized by such a pressing force distribution that the pressure at the center or thereabouts is smaller than that for both ends if the conductive elastic member 99 is pressed by a flat plate (embodiments 1 through 5).

In the conductive brush 94 of the first embodiment wherein the bristles of the brush were 4 mm at the end and 3 mm at the center, the distance G between the intermediate transfer member 7 and grid electrode 92 was 1.1 mm at the end and 1.0 mm at the center when in contact with the intermediate transfer member 7. The brush was almost flat. The electric charge elimination performance was constant along the entire length. A uniform two-color solid image was observed close to both ends and the center, and excellent toner dispersion was recorded in the thin-line portion. Excellent results were obtained.

In the conductive brush 94 of the second embodiment wherein Young's modulus was 1500 N/m$^2$ at the end and 1000 N/m$^2$ at the center, the distance G was 1.1 mm at the end and 0.9 mm at the center when in contact with the intermediate transfer member 7. The brush was almost flat. A uniform two-color solid image was observed, and excellent toner dispersion was recorded in the thin-line portion.

In the conductive brush 94 of the third embodiment wherein the wire size of the brush was 6 d (denier) at the end and 2 d at the center, the distance G was 1.0 mm at the end and 0.9 mm at the center when in contact with the intermediate transfer member 7. The brush was almost flat. A uniform two-color solid image was observed, and excellent toner dispersion was recorded in the thin-line portion.

In the conductive brush 94 of the fourth embodiment wherein brush density was 240 kF at the end and 120 kF at the center, the distance G was 1.1 mm at the end and 1.0 mm at the center when in contact with the intermediate transfer member 7. The brush was almost flat. A uniform two-color solid image was observed, and excellent toner dispersion was recorded in the thin-line portion.

In the sponge of the fifth embodiment wherein the thickness of the conductive foamed member 96 was 5 mm at the end and 4 mm at the center, the distance G was 1.1 mm at the end and 0.9 mm at the center when in contact with the intermediate transfer member 7. The brush was almost flat. A uniform two-color solid image was observed, and excellent toner dispersion was recorded in the thin-line portion.

In the sponge of the sixth embodiment wherein the hardness of the conductive foamed member 96 was 90 at the end and 80 at the center, the distance G was 1.1 mm at the end and 0.9 mm at the center when in contact with the intermediate transfer member 7. The brush was almost flat. A uniform two-color solid image was observed, and excellent toner dispersion was recorded in the thin-line portion.

As described above, when the conductive brush 94 is used as the counter electrode 9B mounted on the pre-secondary transfer electric charge eliminating device 9, the length of the brush bristle, modulus of elasticity of the brush, diameter of wire of the brush, and brush density are set at such a pressing force distribution that they are smaller at the center than at both ends. This arrangement ensures that the distance G between the intermediate transfer member 7 and grid electrode 92 is kept uniform from the end to the center. This prevents the intermediate transfer member close to the center from becoming loose, and the distance between the discharge electrode and intermediate transfer member is kept uniform in the transversal direction to the direction in which the intermediate transfer member rotates. Thus, safe and excellent electric charge elimination is ensured, and a high-quality image is provided, despite possible increase in the linear speed of the intermediate transfer member resulting from increased image formation speed. This arrangement is effective especially in solving toner dispersion problems on the thin line portion of the image, and in improving the uniformity of two-color solid images.

The present embodiment has been described with reference to the case where an intermediate transfer belt is used as the intermediate transfer member 7. This present invention is also applicable to a transfer belt. Further, the conductive brush 94 and conductive foamed member 96 formed in this manner can also be applied to the charging member or charge eliminating member of the copying machine and printer based on electrophotographic technology.

What is claimed is:

1. A color image forming apparatus, comprising:

a plurality of image forming sections to form toner images of respective colors;

a primary transfer section to transfer and superimpose the toner images of multiple colors onto a rotating intermediate transfer member;

a secondary transfer section to transfer the toner images superimposed on the intermediate transfer member collectively on a transfer material; and a pre-secondary transfer electric charge eliminating device arranged between the primary transfer section and the secondary transfer section including, a discharge electrode arranged on the side opposite to the toner carrier surface of the intermediate transfer member and a counter electrode formed by a conductive elastic member arranged at a position opposite to the discharge electrode beyond the intermediate transfer member so as to press the intermediate transfer member, wherein the pressing force of the counter electrode against the rear surface of the intermediate transfer member is distributed in such a way that the pressure for the center of the intermediate transfer member is smaller than that for both ends thereof, in the transversal direction to the direction in which the intermediate transfer member rotates.

2. The color image forming apparatus of claim 1, wherein the conductive elastic member of the counter electrode is a conductive brush.

3. The color image forming apparatus of claim 2 wherein, a length of bristle of the conductive brush opposing to the center of the intermediate transfer member is shorter than a length of the bristle opposing to both ends thereof.

4. The color image forming apparatus of claim 2 wherein, a coefficient of elasticity of the conductive brush opposing to the center of the intermediate transfer member is smaller than a coefficient of elasticity thereof opposing to both ends thereof.

5. The color image forming apparatus of claim 2 wherein, a diameter of the wire of the conductive brush opposing to the center of the intermediate transfer member is smaller than a diameter of the wire opposing to both ends thereof.

6. The color image forming apparatus of claim 2 wherein, a density of the bristle of the conductive brush opposing to the center of the intermediate transfer member is smaller than the density of the bristle opposing to both ends thereof.

7. The color image forming apparatus of claim 1 wherein, the counter electrode is constructed by a conductive porous member.

8. The color image forming apparatus of claim 7 wherein, a thickness of the conductive porous member opposing to the center of the intermediate transfer member is smaller than a thickness of the conductive porous member opposing to both ends thereof.

9. The color image forming apparatus of claim 7 wherein, a hardness of conductive porous member opposing to the center of the intermediate transfer member is smaller than a hardness of conductive porous member opposing to both ends thereof.

10. The color image forming apparatus of claim 1 wherein, the discharge electrode is constructed by a scorotron having a grid electrode.

11. The color image forming apparatus of claim 10 wherein, the electric potential of the grid electrode is not more than the that of the portion where the maximum amount of toner is adhering in the toner image and not less than the portion where the toner is not adhering.

12. The color image forming apparatus of claim 10 wherein, a direct current of opposite polarity to the toner is applied to the charging wire of the scoroton.

* * * * *